US005613462A

United States Patent [19]

Schwartz

[11] Patent Number: 5,613,462

[45] Date of Patent: Mar. 25, 1997

[54] LIFTING DEVICE

[76] Inventor: John B. Schwartz, 341 NE. 3rd Ave., Dania, Fla. 33004

[21] Appl. No.: 606,843

[22] Filed: Feb. 26, 1996

Related U.S. Application Data

[63] Continuation-in-part of Ser. No. 373,423, Jan. 17, 1995.

[51] Int. Cl.[6] ..... B63B 17/00

[52] U.S. Cl. ..... 114/362; 114/48

[58] Field of Search ..... 114/343, 362, 114/48; 14/71.7; 182/53, 55, 150; 248/641, 642, 281; 440/55, 61

[56] References Cited

U.S. PATENT DOCUMENTS 4,757,971 7/1988 Mapes ..... 440/1

4,842,559 6/1989 Litjens et al. ..... 440/1

*Primary Examiner*—Jesus D. Sotelo

*Attorney, Agent, or Firm*—Joseph Zallen

[57] ABSTRACT

A novel lifting device for small craft in which the mechanism includes an hydraulic pump and an hydraulic cylinder pivotally mounted on a first horizontal shaft of a support attached to a boat or stationary surface. A first arm is mounted on the first shaft, and a second arm mounted on a second lower shaft. The piston rod of the cylinder is pivotally connected to the lifting platform. The other end of the first arm is pivotally connected to the lifting platform at a higher position than that of the piston rod. The other end of the second arm is pivotally connected at the same position as the piston rod. When the piston rods are extended, the platform is lower; when the rods are retracted, the platform is higher.

10 Claims, 13 Drawing Sheets

LIFTING DEVICE

BACKGROUND OF INVENTION

This is a continuation-in-part of my application Ser. No. 08/373,423, filed Jan. 17, 1995, is incorporated herein by reference.

This invention relates to a lifting device. In particular it relates to a device attached to a boat or stationary surface and containing a platform which permits the raising or lowering of passengers, swimmers, miscellaneous cargo, or the raising, storing, and lowering of a small carrier such as a dingy or recreational water craft and the like. When used for storing small craft, the platform can be tilted up at the rear for protection from large waves.

Other objects and advantages of this invention will be apparent from the description and claims which follow, taken together with the appended drawings.

BRIEF SUMMARY OF INVENTION

Figure 1:
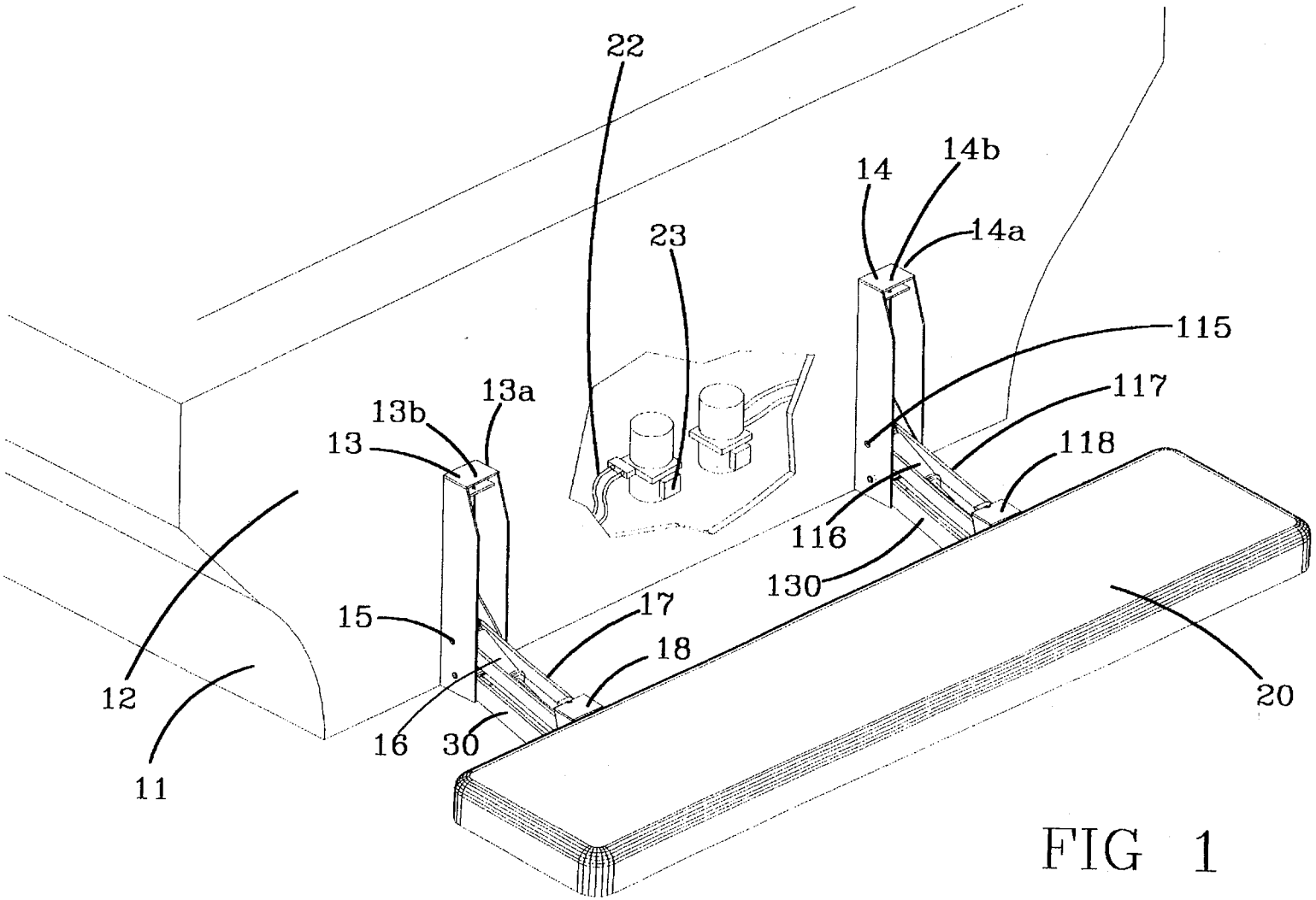
FIG. 1 is a left perspective view of an embodiment of this invention having two lifting mechanisms shown attached to the stern of a small craft in a fully lowered position.
Figure 2:
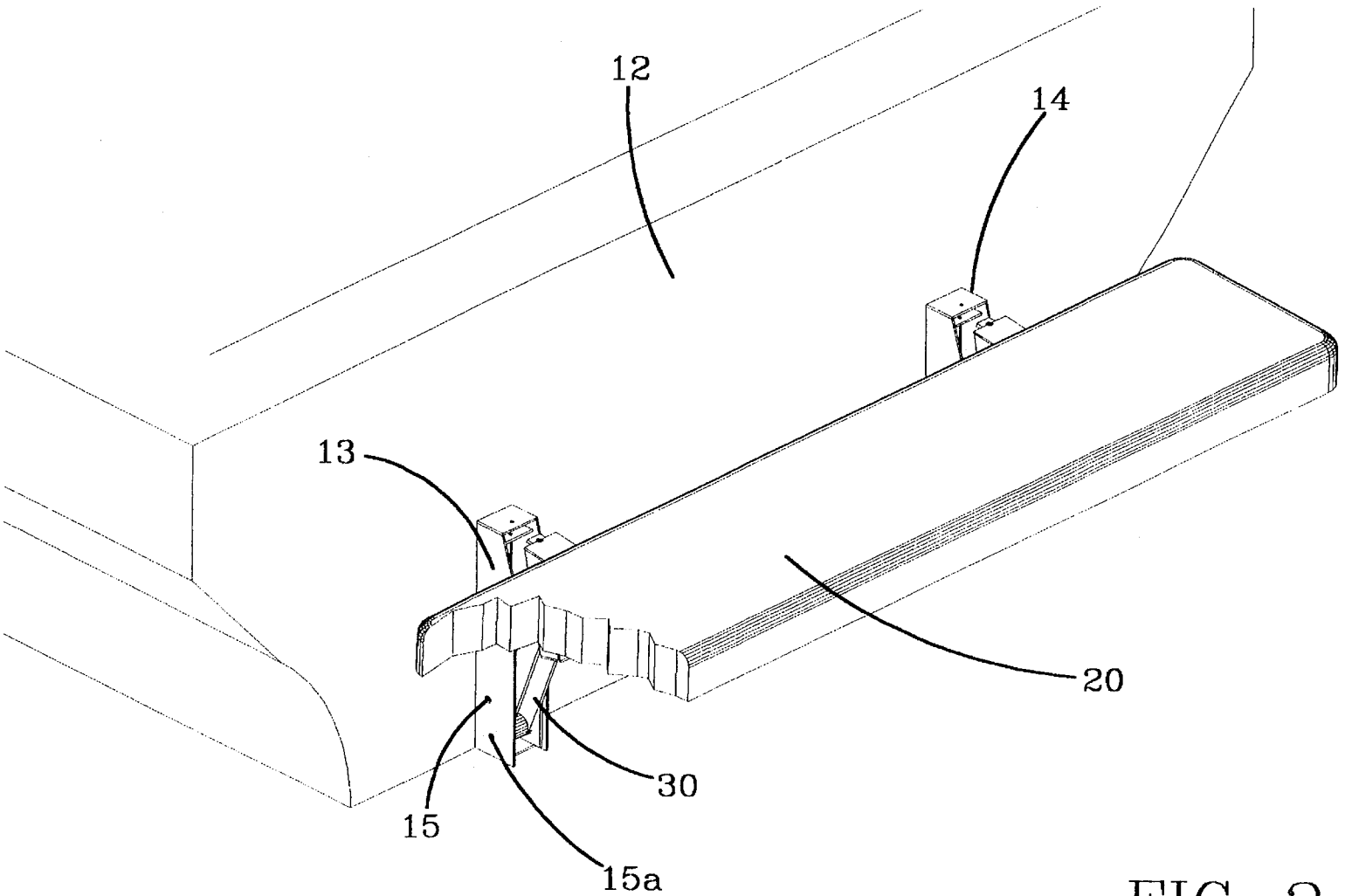
FIG. 2 is a similar view as in FIG. 1, but in its near uppermost position.
Figure 3:
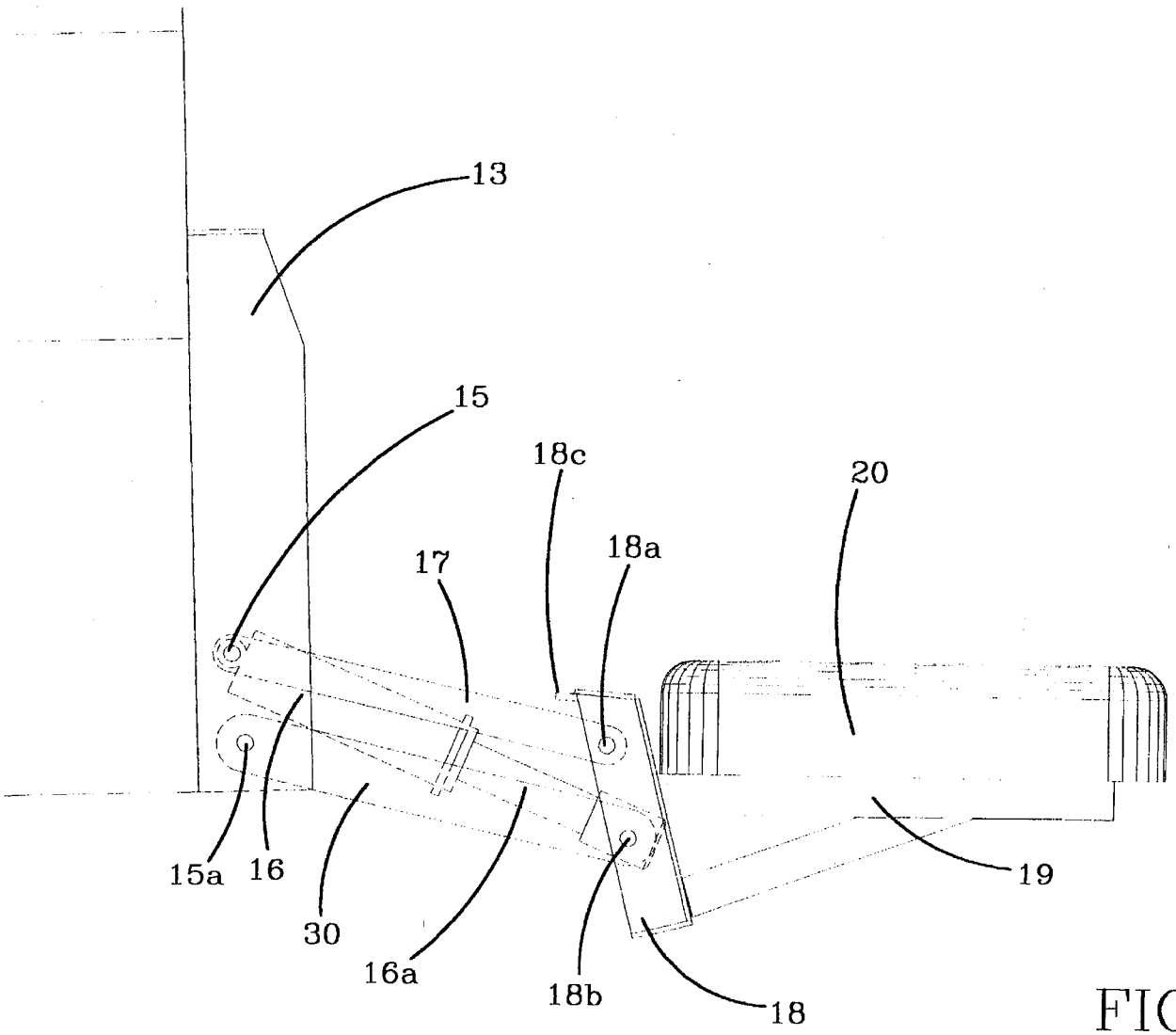
FIG. 3 is a left side view of the embodiment of FIG. 1 in lowest position.
Figure 4:
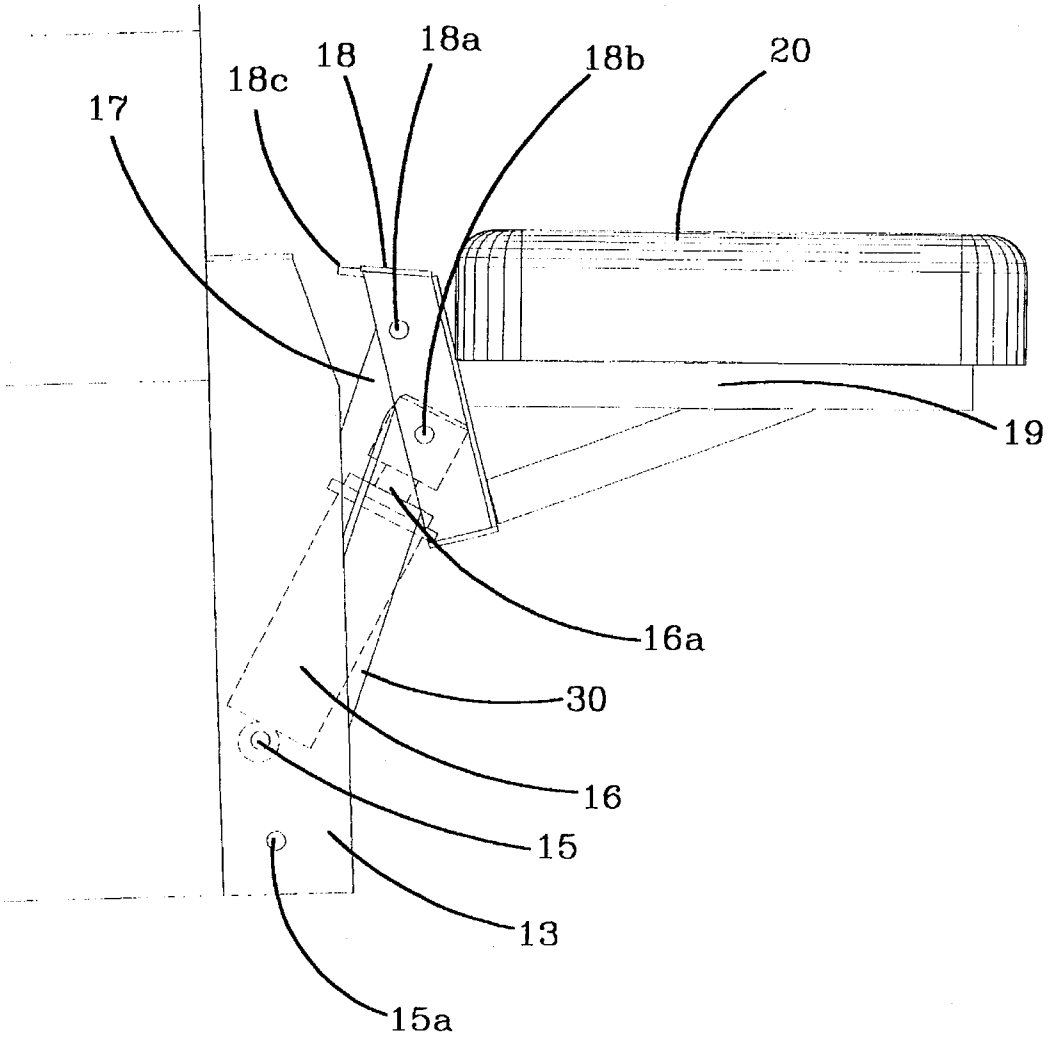
FIG. 4 is a left side view of the embodiment of FIG. 1 in its near uppermost position.
Figure 5:
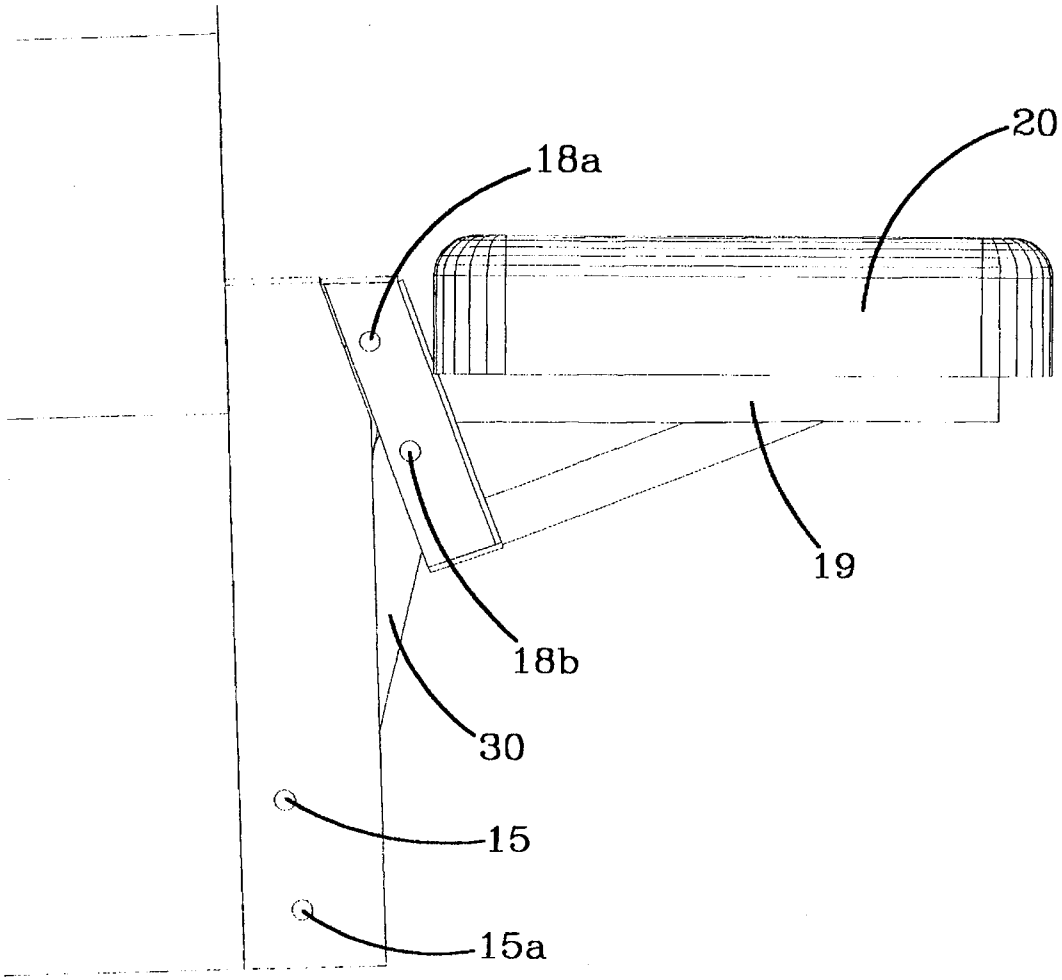
FIG. 5 is an enlarged partial left side view of the embodiment of FIG. 1 in its uppermost position.
Figure 6:
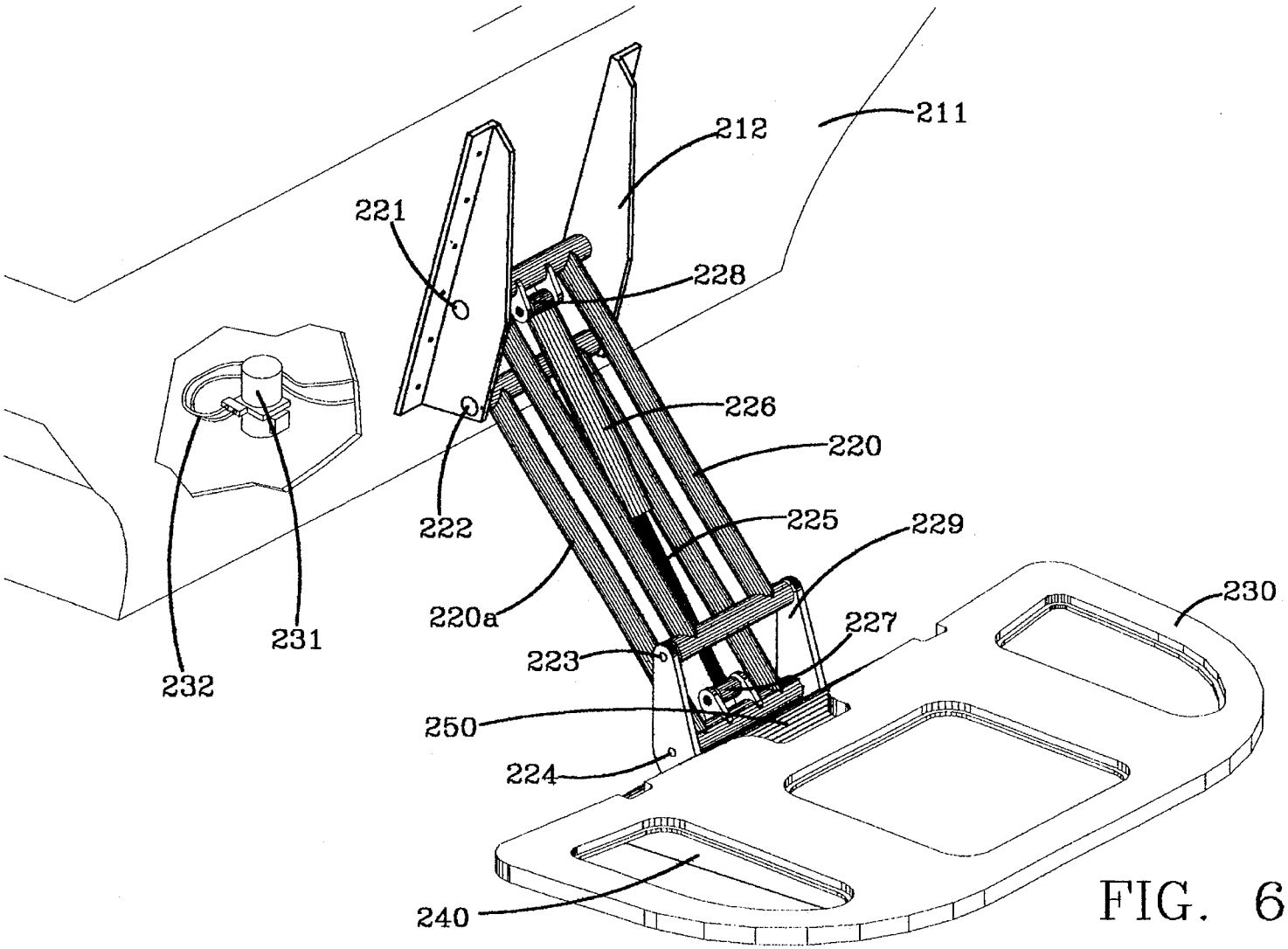
FIG. 6 is a left perspective view of an embodiment of this invention having a central single lifting mechanism shown in lowered position.
Figure 7:
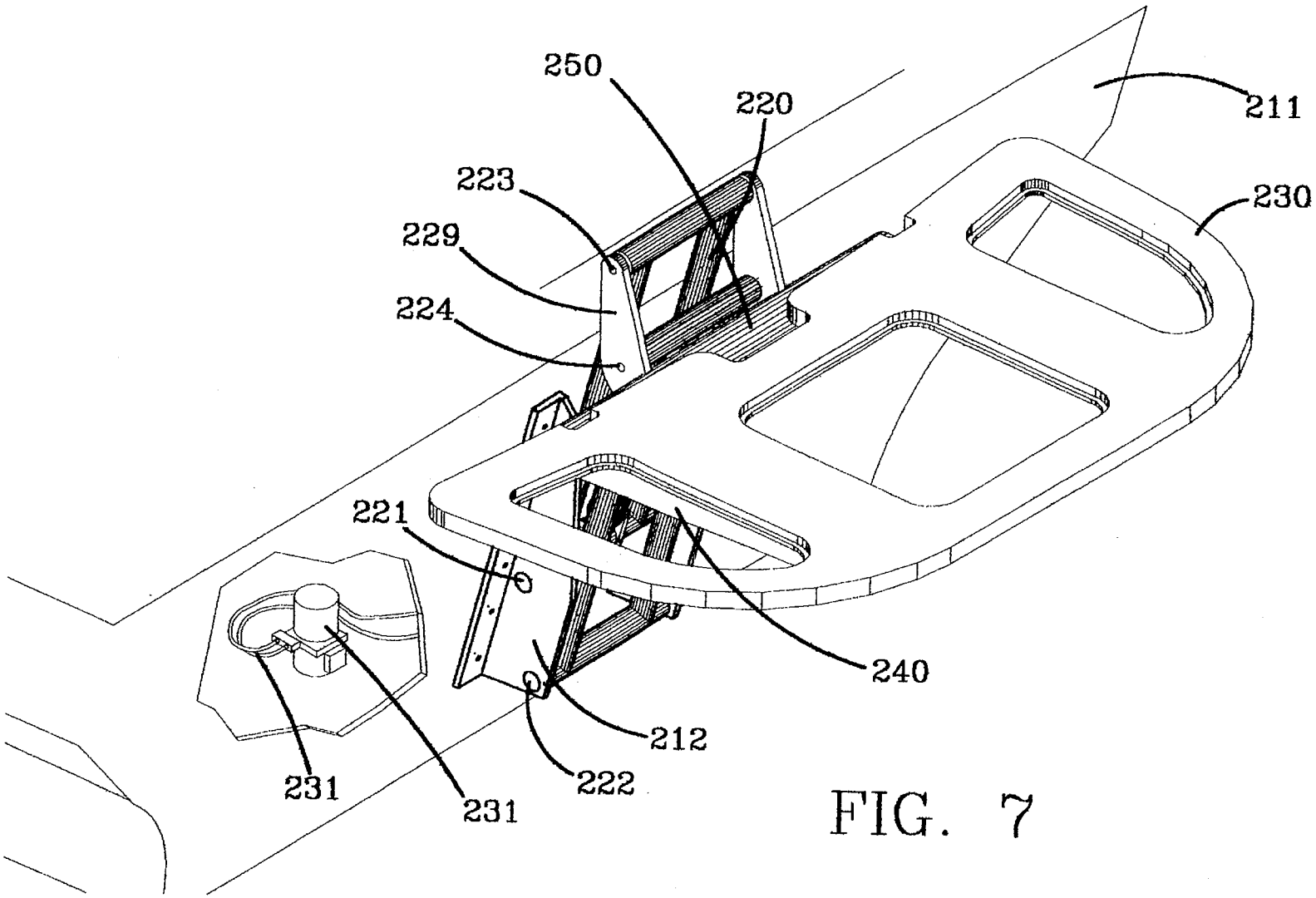
FIG. 7 is the same view as FIG. 6 but in uppermost position.
Figure 8:
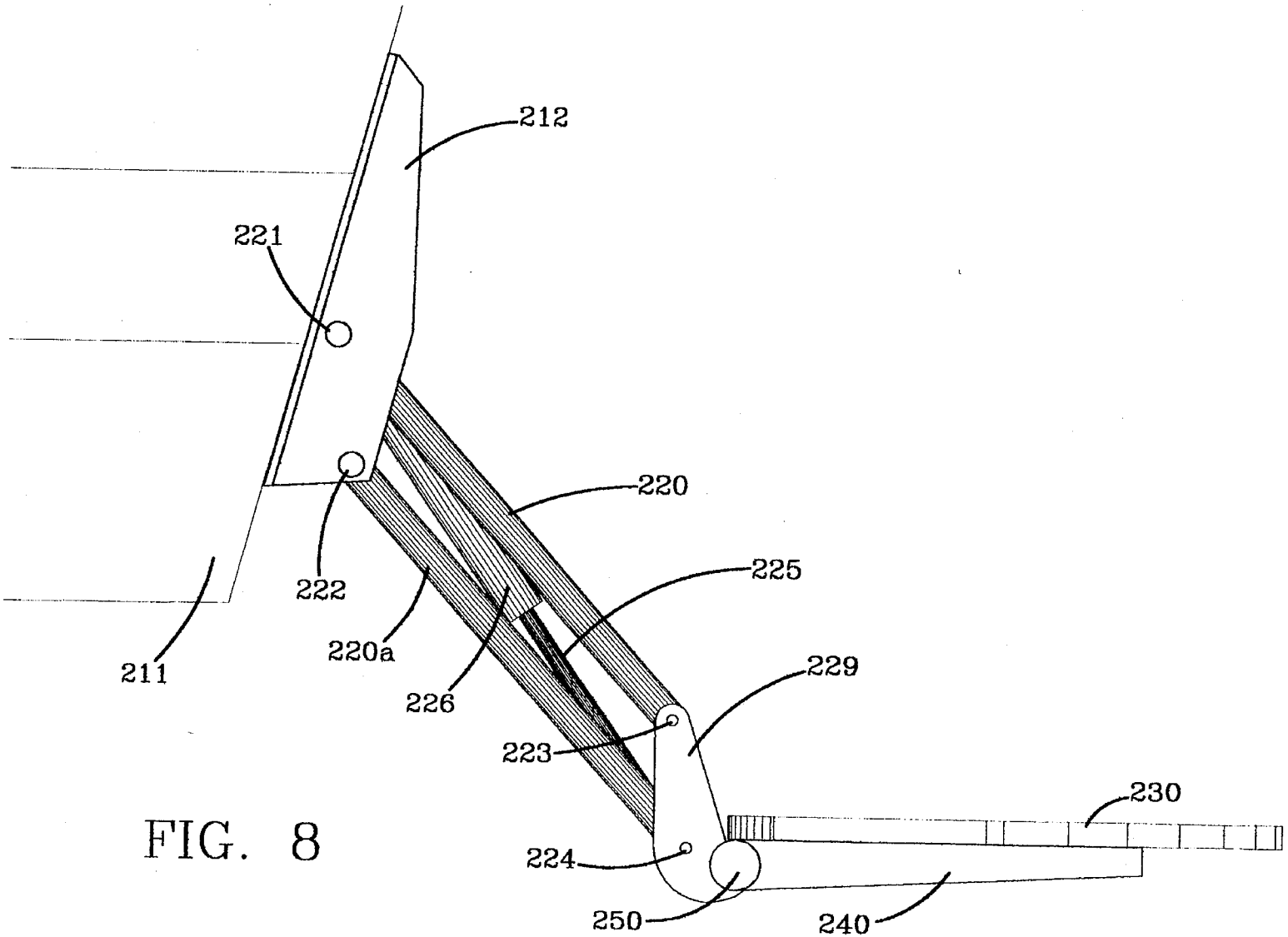
FIG. 8 is a left side view of FIG. 7.
Figure 9:
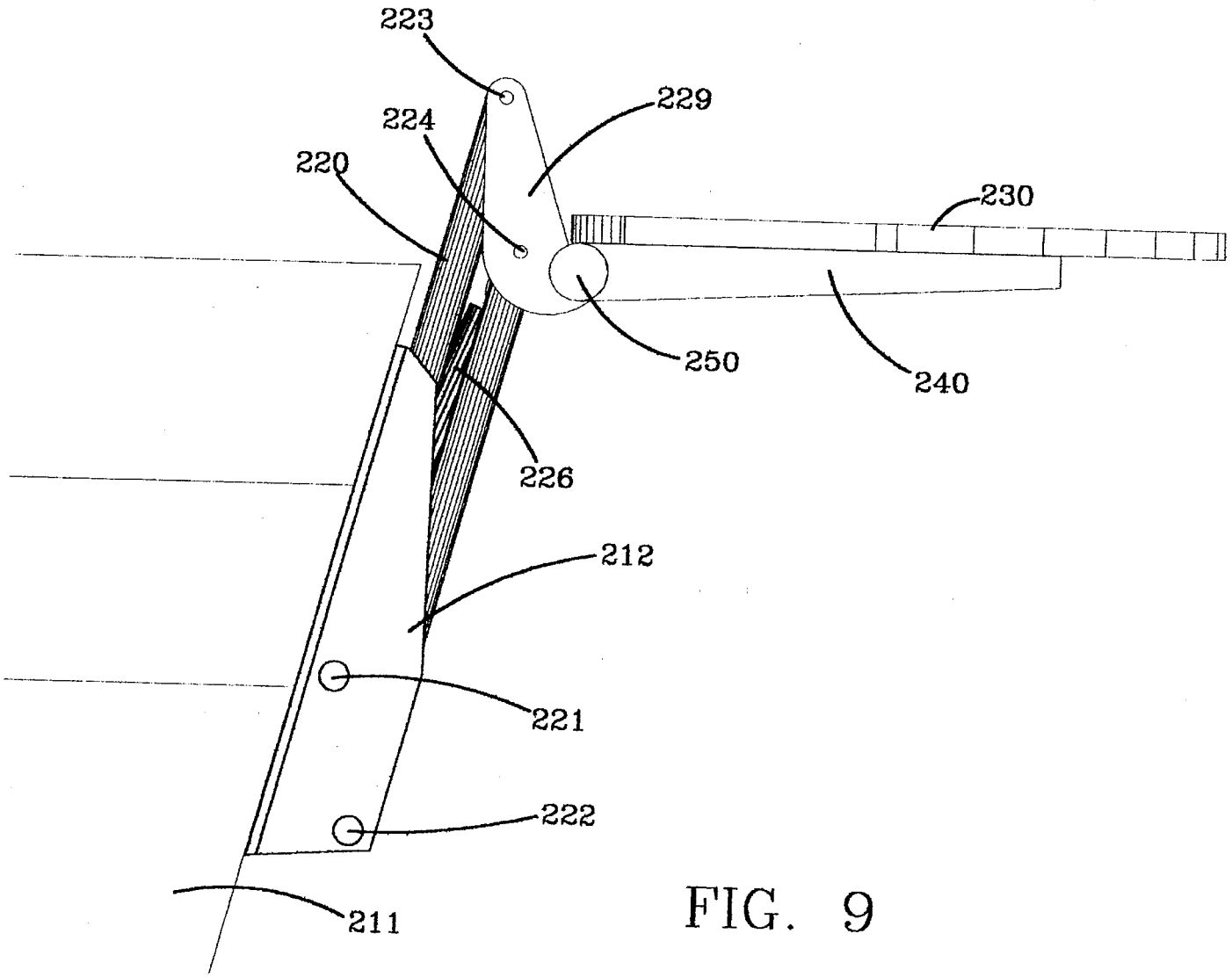
FIG. 9 is a left side view of FIG. 7.

This mechanism of this invention comprises generally an hydraulic pump, an hydraulic cylinder connected to the pump and pivotally mounted on a housing which is itself mounted on a boat or stationary surface, and a piston rod movable in the cylinder and connected to a vertically movable bracket supporting a platform. The housing has an upper horizontal shaft and a lower horizontal shaft. The movable bracket also has an upper horizontal shaft and a lower horizontal shaft. The hydraulic cylinder is pivotally mounted on the upper shaft of the housing, while its piston rod is pivotally mounted on the lower horizontal shaft of the movable bracket. An upper arm is pivotally connected to the upper horizontal shaft of the housing and the upper horizontal shaft of the bracket. Another arm is pivotally connected between the lower horizontal shaft of the housing and the lower horizontal shaft of the movable bracket. Accordingly, retraction of the piston rod causes the bracket to be raised, thus raising the platform, and extension of the piston rod causes the bracket to be lowered thus lowering the platform.

In this invention there can be one or more mechanisms. In each mechanism an arm and hydraulic cylinder are pivoted on the same horizontal shaft located in a housing mounted on a boat or stationary surface. The other end of the arm is pivotally connected to the upper portion of a movable bracket while the end of the cylinder piston rod and a second arm are connected to the lower portion of the bracket. The other end of the second arm is pivotally connected to a second horizontal shaft located below the first horizontal shaft. When the piston is extended fully, the bracket is at its lowest position. When the piston is retracted, the bracket is at its highest position. Each bracket has one or more horizontal support arms so that a platform is supported transversely to the mounting surface. In one form of the invention, using two or more mechanisms, a single horizontal support arm is pivotally attached to each bracket to enable the platform to tilt up at the rear edge by means of a separate hydraulic cylinder pivotally attached to each bracket below the horizontal support arm attachment. The piston rod of each of these cylinders is also pivotally attached to its horizontal support arm.

The lifting device of this invention can be attached to the stem of a boat or to a stationary surface, as for example a sea wall, dock, or the like. It permits a platform to be raised, lowered, and locked so as to lift passengers, cargo, tender, or the like. In one embodiment this device also permits the platform to be tilted upward at the aft end, when in rough seas or when the boat is running with the bow up and the stem is depressed.

Operation and control of the hydraulic cylinders can be provided in any manner as common to the hydraulic arts, including using such elements as bi-directional pumps, flow dividers, and solenoid valves. In the present invention where two or more mechanisms are used together, a single pump can be used or separate pumps can be used.

SPECIFIC EXAMPLES OF INVENTION

Example 1

Referring now to FIGS. 1–5 in the drawings, one embodiment of the invention is shown attached to the stern 12 of a small vessel 11. A pair of vertical housings 13 and 14 are attached to the stern 12. Extending horizontally through the lower portion of housings 13 and 14 are shafts 15 and 115. Pivotally mounted on shafts 15 and 115 respectively are hydraulic cylinders 16 and 116 which have their piston rods 16*a* and 116*a* mounted pivotally on pins 18*b* and 118*b* in brackets 18 and 118 respectively. Also pivotally mounted on shafts 15 and 115 respectively are arms 17 and 117 whose ends are pivotally mounted on brackets 18 and 118 above the piston rods at pins 18*a* and 118*a*. The housings 13 and 14 also have horizontal shafts 15*a* and 115*a* positioned below shafts 15 and 115. Mounted on shafts 15*a* and 115*a* are lower arms 30 and 130 whose other ends are pivotally connected to brackets 18 and 118 at pins 18*b* and 118*b*. Brackets 18 and 118 include horizontal support arms 19. Spanning the horizontal support arms 19 is a lifting platform 20.

In the upper position of the lifting device the brackets 18 and 118 have their plates 18*c* extending into the tops 13*a* and 14*a* of housings 13 and 14 so as to be lockable by locking pins extending through holes 13*b* and 14*b*.

Each of hydraulic cylinders 16 and 116 is connected to a source of hydraulic oil by a pair of hydraulic lines 22 attached to a motor-driven, bi-directional hydraulic pump 23 which can be housed inside the vessel near the stern. When the pump is exerting pressure on the piston rods 16*a* and 116*a*, they are fully extended causing the platform to be in the lowest position. When the hydraulic pressure is reversed the piston rods are retracted causing the platform to be raised to its upper position. The hydraulic pump provides positive locking in any position.

Example 2

Referring now to FIGS. 6, 7, 8, and 9 in the drawings, another embodiment of the invention is shown attached to the stem of a small vessel 211. A pair of mounting brackets 212 are mounted on the stem. Upper arm assembly 220 is shown pivotally mounted on the brackets on upper pin 221 and lower pin assembly 220*a* on lower pin 222. Assembly 220 is connected to a platform support 229 by an upper pin 223, and an assembly 220*a* is connected by a lower pin 224. A platform 230 is attached to the platform support 229. The platform support and the platform are movable by the action of an hydraulic piston rod 225 in a cylinder 226. Cylinder 226 is pivotally mounted on the upper portion of the assembly 220 by a pin 228, while the end of the piston rod 225 is pivotally mounted on the lower end of the platform support by pin 227.

A bi-directional hydraulic pump 231 is connected by a pair of hydraulic lines 232 to cylinder 226. When the pump is exerting pressure on the piston rod 225, the piston rod is fully extended causing the platform and platform support to be in lowest position. When hydraulic pressure is reversed, the piston rod retracts, thus causing the platform and platform support to be raised to its upper position. The hydraulic pump provides positive locking in any position.

Example 3

Figure 10:
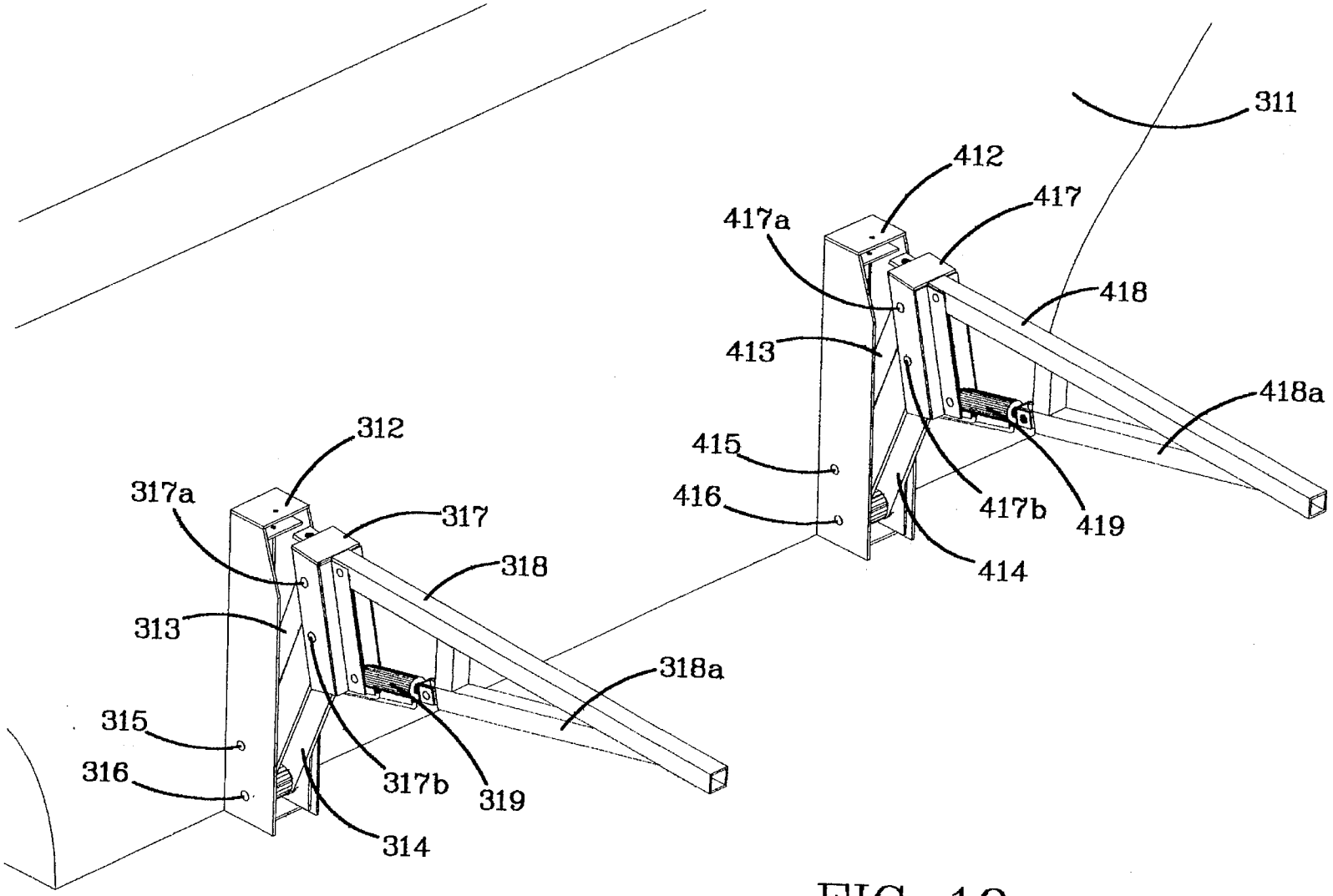
FIG. 10 is a left perspective view of an embodiment having two tiltable lifting mechanisms shown untilted, with the platform removed.
Figure 11:
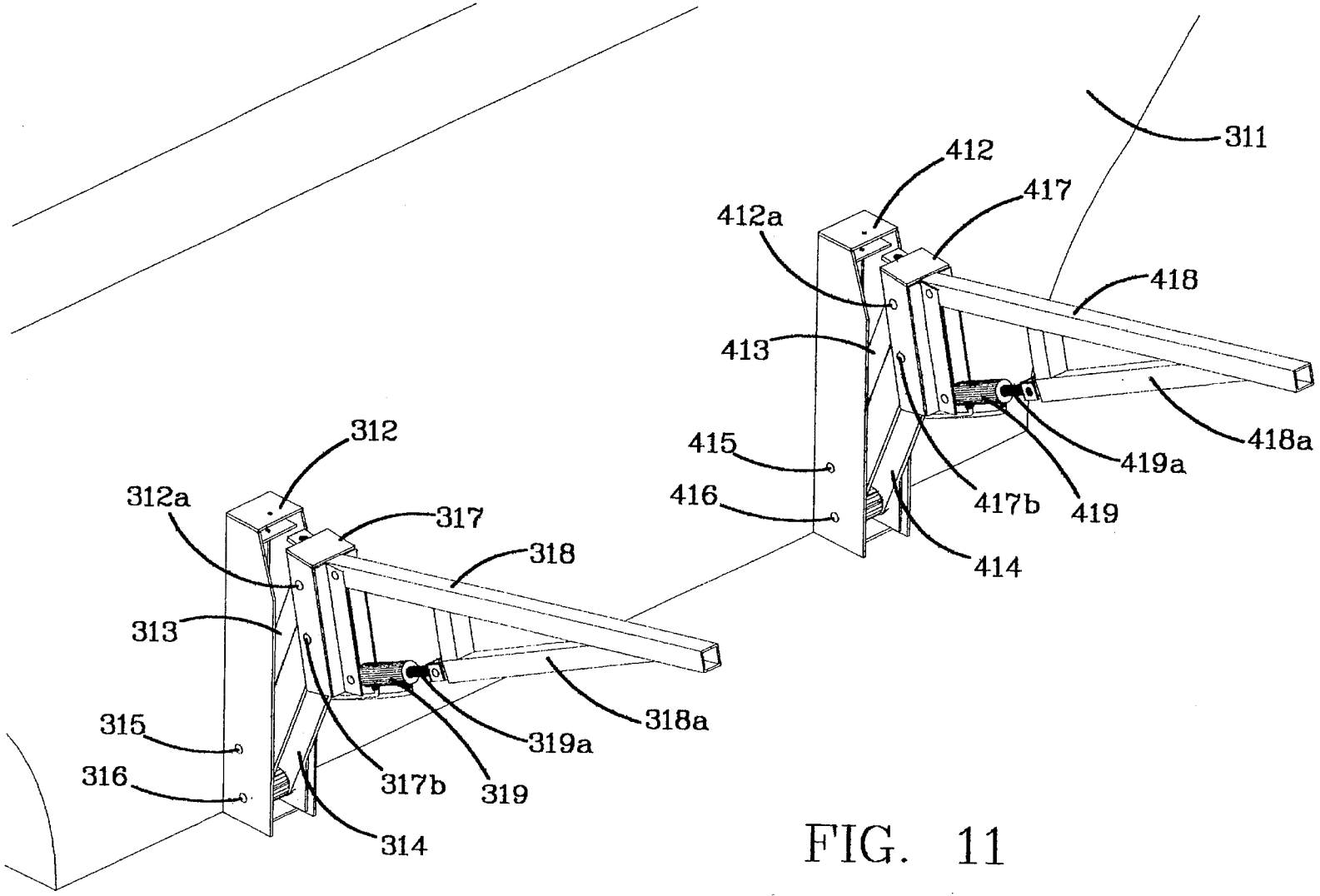
FIG. 11 is a view as in FIG. 10 but tilted.
Figure 12:
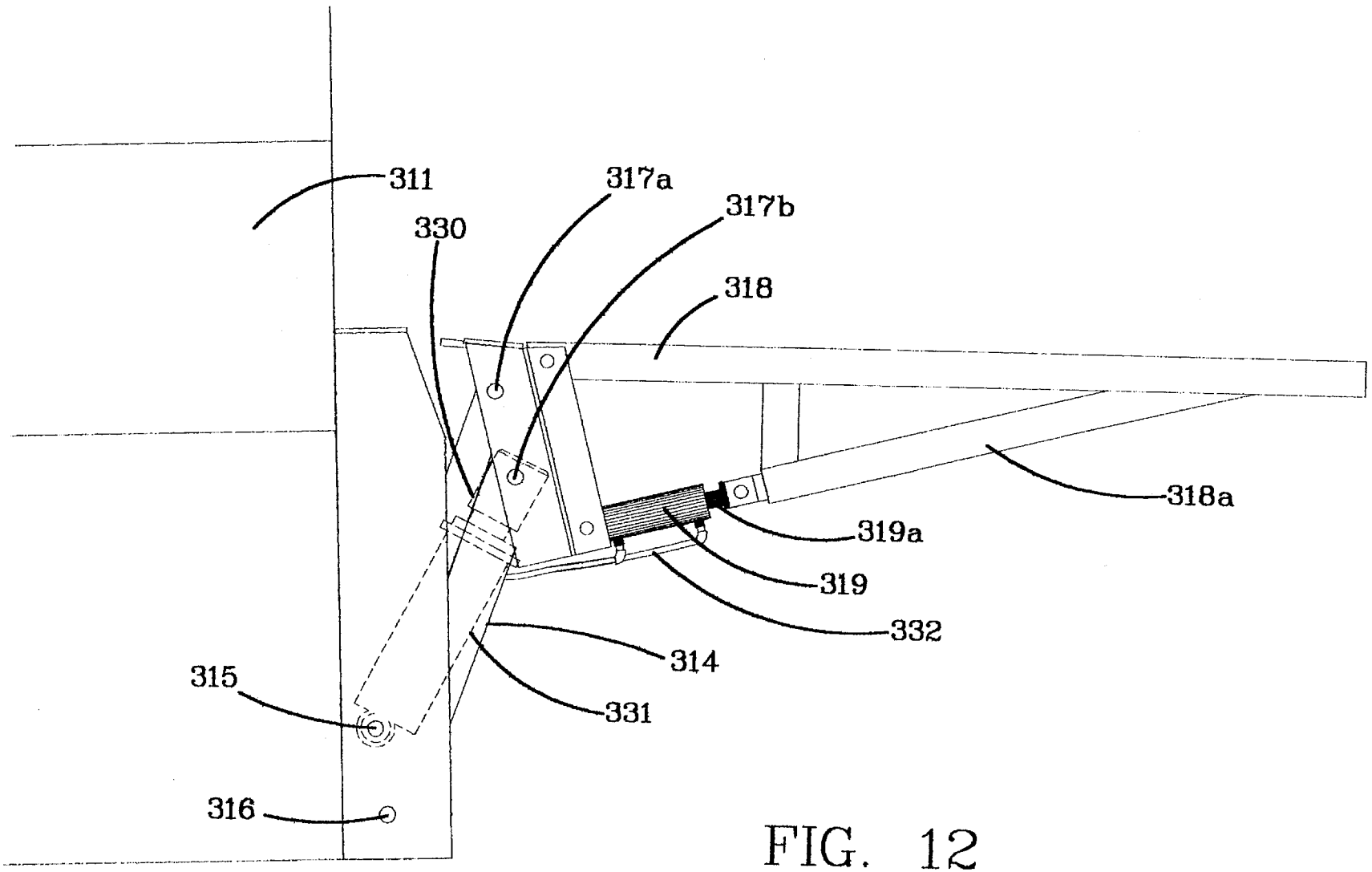
FIG. 12 is a side view of FIG. 10.
Figure 13:
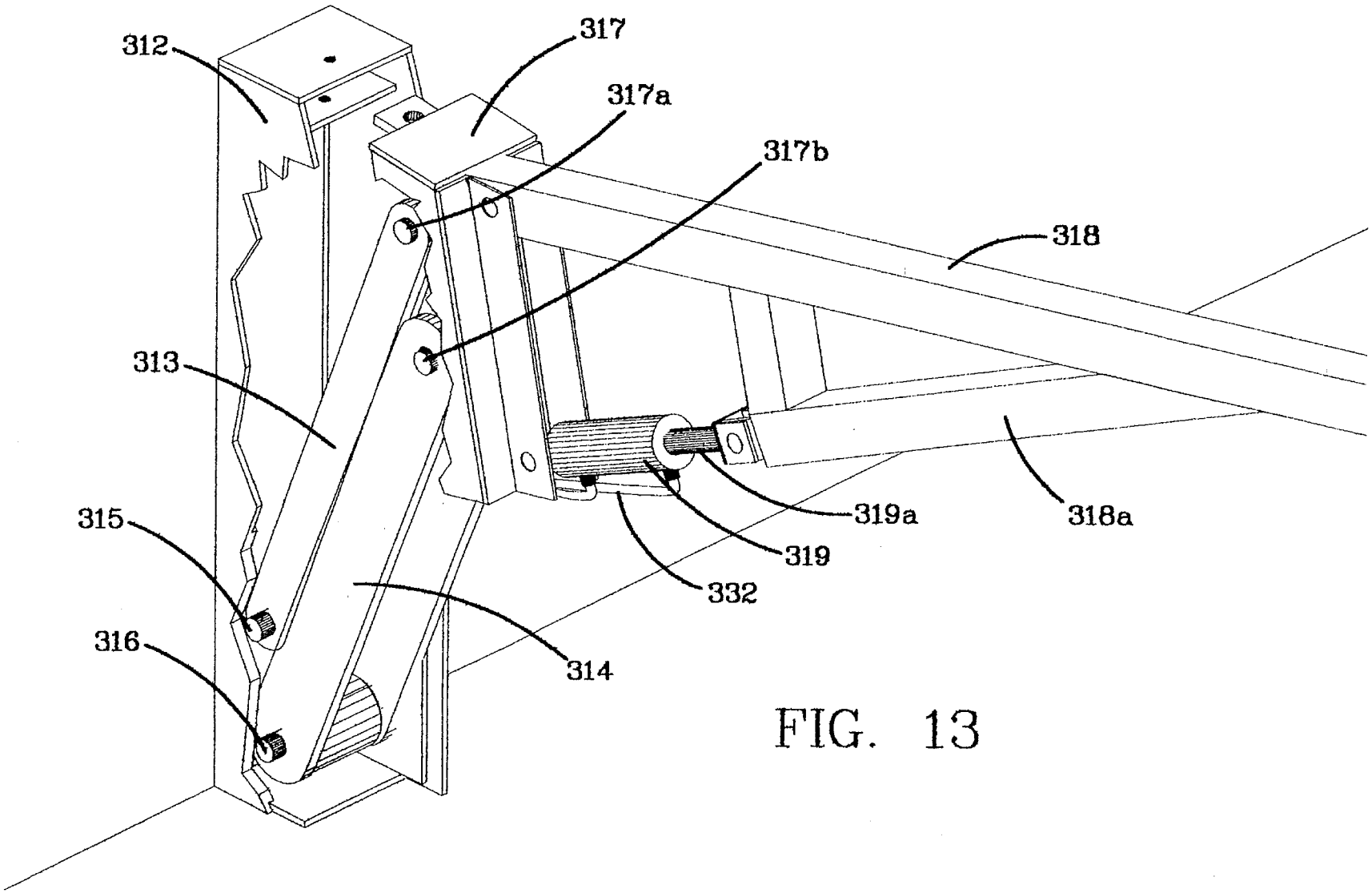
FIG. 13 is an enlarged partially cutaway view of FIG. 11.

Referring now to FIGS. 10, 11, 12, and 13, there is illustrated therein an embodiment (with the platform removed) permitting tilting of horizontal support members 318, 418. The mechanisms in this embodiment are substantially identical and support the platform. Each has a mounting bracket 312, 412 attached to the stern of vessel 311 and has an upper horizontal shaft 315, 415 and a lower horizontal shaft 316, 416. Pairs of spaced arms 313, 314 and 413, 414 pivotally connect support blocks 317, 417 with shafts 315, 415 and 316, 416. In the left mechanism an hydraulic cylinder 331 is pivotally connected to horizontal shaft 315, and its piston rod is pivotally connected to block shaft 317*b*. In the right mechanism is a similar cylinder (not visible) which is pivotally connected to shaft 415 and its piston rod pivotally connected to block shaft 417*b*. Block 317, 417 has an upper horizontal shaft 312*a*, 412*a* on which spaced arms 313 pivot, and a lower horizontal shaft 317*b*, 417*b* on which spaced arms 314, 414 pivot. A separate hydraulic cylinder 319, 419 is mounted on head 317, 417 with its piston rod 319*b*, 419*b* connected to support member 318, 418, and the cylinder is connected by pipes 332 to an hydraulic pump (not illustrated). Support blocks 317, 417 are pivotally mounted on upper arms 313, 413 and lower arms 314, 414. Horizontal support members 318, 418 have lower portions 318*a*, 418*a* connected to the piston rods 319*b*, 419*b*, of pistons 319, 419, whose base is mounted on the lower portions of support heads 317, 417. In FIG. 10, the piston rods are retracted, and the support members 318, 418 are in upper position, untilted. In FIG. 11, the piston rods are shown extended whereby the support members are in lower position and tilted. When a tender is stored on top of the platform, typically four straps and two chocks are used. The after side of the chocks can be cut away to permit launching and retrieval from aft of the platform. A hand rail on the forward edge of the platform can be provided to permit easy alignment of tender and chocks for lifting.

I claim:

1. A lifting device comprising: a housing having two spaced vertical plates and mounted on a boat or stationary surface, upper and lower horizontal shaft means mounted and extending between said plates, a vertically movable bracket means including two spaced horizontal support arms and having upper and lower horizontal shaft means, a platform means supported by and spanning said support arms, said platform means being of sufficient width and length to support watercraft, hydraulic cylinder means pivotally mounted on said housing upper shaft means, piston rod means engageable with said hydraulic cylinder means and pivotally mounted on said bracket lower horizontal shaft means; first arm means pivotally connected to said upper housing horizontal shaft means and said upper bracket horizontal shaft means; second arm means pivotally connected to said lower housing horizontal shaft means and said lower bracket horizontal shaft means; said device being characterized in that retraction of said piston rod means causes said bracket means to rise, thus raising said platform means and extension of said piston rod means causes said bracket means to lower thus lowering said platform means; said device being characterized as permitting the raising or lowering of watercraft on its platform means.

2. The device of claim 1 wherein the housing is mounted on the exterior of a boat.

3. A lifting device mounted on a boat or stationary surface comprising two spaced assemblies each powered by hydraulic pump means (23), and a platform (20) spanning and supported by said assemblies; said platform being of sufficient width and length to support watercraft; each assembly being mounted on a support (13) comprising two spaced vertical plates and having a first horizontal shaft (15) and a second horizontal shaft (15*a*) below said first shaft (15), both said shafts extending between said plates, an hydraulic pump (23), an hydraulic cylinder (16) pivotally mounted on said shaft (15) and connected to said pump means (23), a piston rod (16*a*) movable in said cylinder (16), and an arm means (17) pivotally mounted on said shaft (15); the other end of said arm means (17) being pivotally mounted on a first horizontal shaft (18*a*) of a bracket means (18); said bracket means including a horizontal support arm (19) supporting said platform (20) and a second horizontal shaft (18*b*) spaced at a position below said first shaft (18*a*), the end of said piston rod (16*a*) being pivotally mounted on said second horizontal shaft (18*b*) on said bracket means (18) and a second arm means (30) being pivotally mounted on said lower shaft (15*a*), the other end of said second arm means (30) being pivotally mounted on said second shaft (18*b*) on said bracket means (18) at a position below said first shaft (18*a*); said device being characterized in that when said piston rods are retracted, said platform is raised, and when said piston rods are extended, said platform is lowered; said device being characterized as permitting the raising or lowering of watercraft on its platform.

4. The device of claim 3 wherein said supports (13) are mounted on the exterior (12) of a boat (11).

5. The device of claim 3 wherein means are provided for locking the platform in upper position.

6. The device of claim 3 wherein for each assembly there is a support block means (317) pivotally connected by spaced arms mean (313, 314) to said upper and a lower housing shaft (315, 316), an additional hydraulic cylinder (319) pivotally connected to the lower portion of said support block means (317), and a piston rod (319*a*) cooperating with said additional cylinder (319) and pivotally connected to a depending lower portion (318*a*) of said support block means, said device being so characterized that when said additional piston rods are retracted, said platform is level, but when extended, said platform is tilted up at the rear edge.

7. A single lifting mechanism for raising and lowering a platform (230) having sufficient width and length to support watercraft; said mechanism comprising: a support (212) which is attached to a boat or stationary surface and includes two vertical plates; a first horizontal shaft means (221) and a second horizontal shaft means (222) spaced below said first shaft means (221), both said shaft means extending between said plates, an hydraulic pump means (231), an hydraulic cylinder means (226) pivotally mounted on said first shaft means (221) and connected to said pump means (231), a piston rod (225) movable in said cylinder means (226), and first arm means (220) pivotally mounted on said first shaft means (221); the other end of said arm means (220) being pivotally mounted on a third horizontal shaft means (223) on a bracket means (229); the end of said piston rod (225) being pivotally mounted on a fourth horizontal shaft means (224) on said bracket means (229) at a position below said first arm means (220); and a second arm means (220*a*) being pivotally mounted on said second shaft means (222), the other end of said arm means (220*a*) being pivotally mounted on said fourth shaft means (224) on said bracket means (229) at a position below said arm means (220); said bracket means (229) including a pair of horizontal support arms (240) connected to a cross member (250) for supporting said platform (230); said mechanism being characterized in that when said piston rod (225) is retracted, said platform is raised, and when said piston rod is extended, said platform is lowered; said device being characterized as permitting the raising or lowering of watercraft on said platform.

8. The mechanism of claim 7 wherein said first arm means (220) comprises a pair of spaced members pivotally mounted on said first horizontal shaft means (221) and bracket means (229) and said seconds arm means (220*a*) comprising a pair of spaced members mounted on said lower second horizontal shaft means (222) and said bracket means (229).

9. The mechanism of claim 7 mounted on the exterior of a boat.

10. The mechanism of claim 7 mounted on a stationary surface.

* * * * *